US005180242A

United States Patent [19]

De Laforcade

[11] Patent Number: 5,180,242

[45] Date of Patent: Jan. 19, 1993

[54] ROLL-ON APPLICATION WITH FRANGIBLE CAP

[75] Inventor: Vincent De Laforcade, Clamart, France

[73] Assignee: L'Oreal, Paris, France

[21] Appl. No.: 690,264

[22] Filed: Apr. 24, 1991

[30] Foreign Application Priority Data

May 10, 1990 [FR] France ..... 90 05803

[51] Int. Cl.[5] ..... A45D 34/04

[52] U.S. Cl. ..... 401/132; 220/276; 401/209; 401/213

[58] Field of Search ..... 401/208, 209, 213, 216, 401/220, 132; 222/107; 220/276

[56] References Cited

U.S. PATENT DOCUMENTS 1,080,747 12/1913 Buckley ..... 220/276

3,221,939 12/1965 Brown ..... 222/107 X

FOREIGN PATENT DOCUMENTS 76418 4/1983 European Pat. Off. ..... 220/276

1038872 10/1953 France ..... 401/216

1215460 11/1959 France ..... 401/208

A2257500 1/1975 France .

A2630409 4/1988 France .

2168931 7/1986 United Kingdom ..... 401/209

*Primary Examiner*—Steven A. Bratlie

[57] ABSTRACT

Roll-on applicator consisting of two components, a ball (9) and a body (1) consisting of a part forming the bottle (2) containing the product (P) to be applied, a part forming the housing (4) for the ball (9) and a part forming the cap (5). This body (1) is obtained by moulding one single component. The invention also relates to the process for the manufacture of the device.

3 Claims, 2 Drawing Sheets

ROLL-ON APPLICATION WITH FRANGIBLE CAP

BACKGROUND OF THE INVENTION

This invention relates to a roll-on applicator for a liquid or pasty product, especially for a cosmetic or pharmaceutical product, the device being of the type comprising a container and an applicator means consisting of a ball. This invention also relates to a process for the manufacture of this device.

Numerous applicators comprising one or more balls are known. They are used extensively for the application of cosmetic products, e.g. deodorants. These devices generally consist of a bottle made of glass, rigid plastic or flexible plastic, a housing system for the ball (or balls), one or more balls and a closure device. This closure device can be disposed upstream of the ball, e.g. as in FR-A-2 619 689 and FR-A-2 623 476, or downstream of the ball. In the second case, the closure device generally consists of a cap covering the ball. The ball may consist in the known manner of a spherical, oval or cylindrical rolling body. In the remainder of the description and in the claims, the term "ball" will be used as a generic term covering all the abovementioned types of rolling body.

Roll-on applicators are costly devices, both as a result of the price of the different components forming the device and as a result of the cost of the labour required for their final assembly in the factory, as this assembly necessarily consists of one operation for filling the container, one operation for fitting the ball system and one operation for closing the protective cap for the ball (or balls).

This type of packaging can therefore only be used for products of high added value or for products allowing for numerous applications for a low volume. It is therefore desired to reduce the manufacturing costs of packaging of this kind, so that it can be used for a wider range of products.

In addition, it is also desired to provide samples of the products sold in this type of packaging in a roll-on pack. A promotional presentation of this kind also demands a low cost price.

SUMMARY OF THE INVENTION

Therefore, the object of this invention is to provide a roll-on applicator which is cheaper than the devices known at present.

This invention relates to a roll-on applicator for a liquid or pasty product, consisting of a container containing the product to be applied, a housing system for at least one ball, supplied with the product to be applied by the said container and associated with the corresponding ball (or balls), and a protective cap for the ball(s), characterised in that it comprises a body obtained by moulding a single component forming the container, the housing system for the ball(s) and the cap.

The part of the body forming the container is preferably in the form of a tubular bottle when the device comprises only one ball. However, the container may have a different form when the device comprises a plurality of identical or different balls.

The part of the body forming the housing system for the ball(s) is preferably defined, for each ball, at the side of the part forming the container, by an undercut rib, such that the ball can be introduced into its housing from the container by means of deformation and can be held in the said housing, the said rib being sufficient to hold the ball in place after the introduction thereof and, on the opposite side, by a bearing surface of complementary shape to that of the ball in question, the said bearing surface allowing the ball to project out from the said housing system in the direction of the cap.

The body preferably comprises a tearable zone between the part forming the cap and the part forming the bottle. This zone may consist of a tear strip defined by two weakened lines. It advantageously consists of a thin-walled weakened zone situated between two thicker zones. In that case, the cap is preferably provided with a small bar. By acting on this small bar it is possible to tear the fine wall in order to operate the applicator.

The applicator according to the invention consists of only two components, the body of moulded plastic and the ball. It is therefore inexpensive as the assembly operations are limited and can easily be automated. Moreover, if there is a tearable zone between the cap and the tube, it is impregnable and hygienic. It is therefore possible to package a product in an economic manner in the quantity required for one single application. Consequently, in the case of treatment requiring successive doses, it is possible to use different packs for each dose, thereby preventing the product to be applied remaining in contact with the air following application of the first dose. As the device according to the invention is economical, it can also be used to provide samples.

In order to use the product, the user removes the tear strip or rotates the small bar provided on the cap so as to break the weakened zone. The cap is then removed in order to release the ball. The dose of the product contained in the container is then applied by rolling the ball over the surface to be treated. When the complete dose has been applied, the applicator can be thrown away.

This invention also relates to a process for the manufacture of a roll-on applicator such as the one defined hereinabove, characterised in that:

the body of the device is injection moulded from plastic material, the part forming the container being open at the end opposite the cap and being separated from the cap by a housing system for the ball(s) which opens on to the cap zone by a bearing surface of complementary shape to that of the associated ball, an undercut rib being formed along the edge of the housing system, on the side of the container;

the ball (or balls) is introduced via the part of the container open towards the exterior and each ball is forced into its housing by snap-engagement above the undercut rib;

the container is filled via its part open towards the exterior with the product to be applied, and the part of the container of the moulded body open towards the exterior is closed by means of welding.

It is possible to mould several applicator bodies simultaneously. In that case, several bodies are moulded, filled and welded together. The process is therefore particularly economical. The bodies of the applicators can be moulded individually, but they can be connected together, particularly at the external wall of the container, by means of a breakable or tearable connection, e.g. a tab. In this manner, it is possible to propose a set of applicators for a course of treatment with a cosmetic or pharmaceutical product or products, in which the same product is used several times at different intervals, or several different products are used in a precise and predetermined order.

BRIEF DESCRIPTION OF THE DRAWINGS

The invention will be more readily understood from the following description given purely by way of a non-limiting example and with reference to the accompanying drawings, in which.

DETAILED DESCRIPTION OF THE INVENTION

Figure 1:
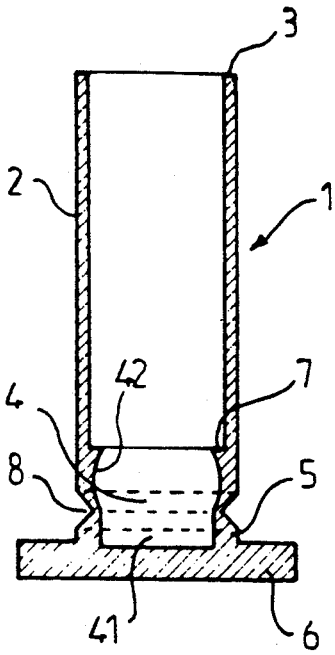
FIGS. 1 to 4 show in diagrammatic form the different steps of a process for the manufacture of an applicator according to the invention comprising one single ball.

FIG. 1 shows the body 1 of the applicator according to the invention obtained by injection moulding of polyethylene, which, when thin-walled, is a flexible material which can be welded to itself. The body 1 comprises a part 2 forming the container of the device. This container 2 is in the form of a tubular bottle, one end 3 of which is open towards the exterior. At the opposite end of the bottle 2, the body 1 comprises a housing 4 for a ball 9 and a cap 5 provided with an outer transverse bar 6.

The housing 4 of the ball 9 consists of a cylindrical zone 41 interior to the cap 5 followed by a zone 42 consisting of a spherical segment. The zone 42 is bordered by a rib 7, which is undercut and is sufficiently weak that it can nevertheless be movable. The wall of the body 1 has a weakened zone 8 between the cap 5 and the zone 42 of the housing 4. The small bar 6 moulded on to the cap 5 projects diametrically over the cap 5 and projects from either side of the latter.

Figure 2:
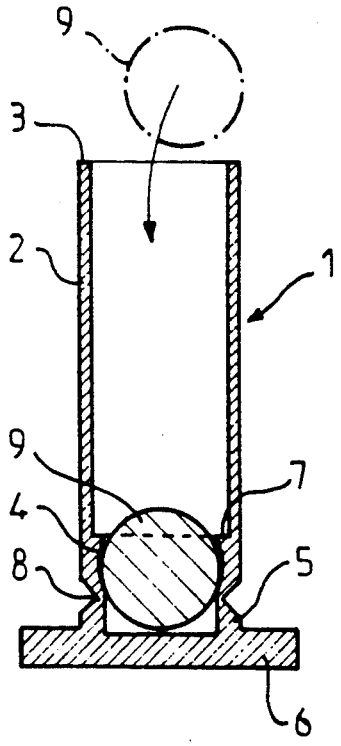
Figure 3:
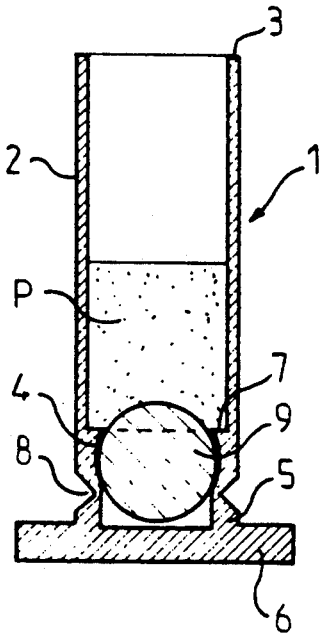
Figure 4:
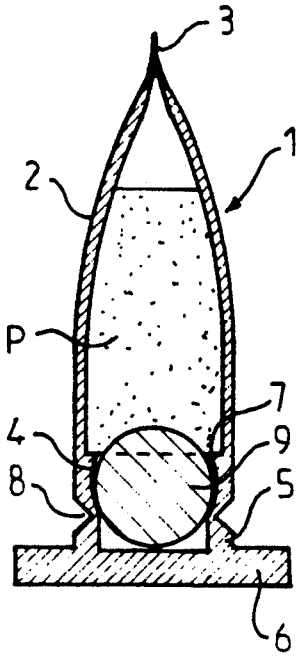
Figure 5:
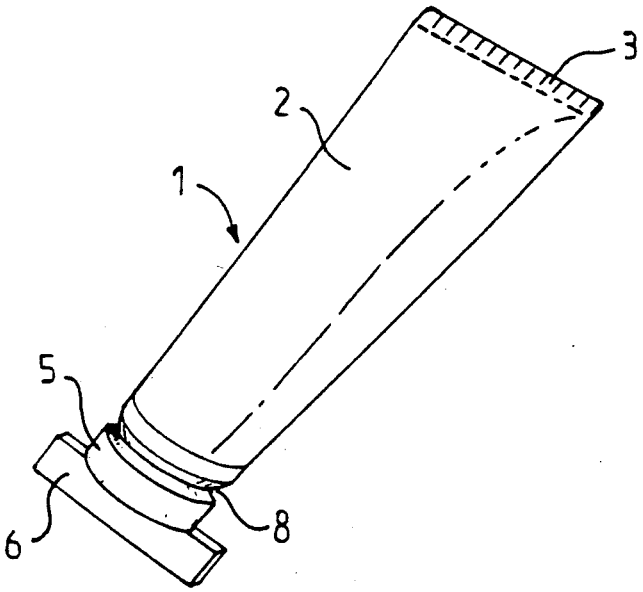
FIG. 5 shows a perspective view of the device obtained by the process of FIGS. 1 to 4.
Figure 6:
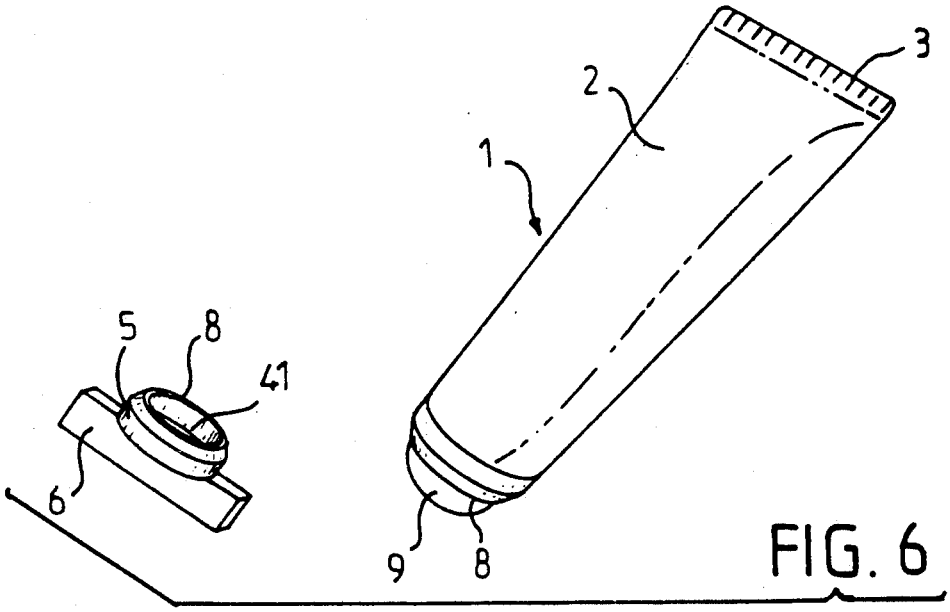
FIG. 6 shows a perspective view of the device of FIG. 5 after opening the cap.

In order to prepare the applicator according to the invention, the ball 9 is introduced via the open end 3 of the bottle 2 and is forced into the housing 4 by snap engagement above the rib 7 which is movable for the passage of the ball 9. When the ball is in place in its housing 4 (see FIG. 2), the tube 2 is filled with the aid of the product P to be applied. The rib 7 forms a sufficiently tight joint with the ball, so that irrespective of any pressure, the product P remains in the part forming the container. When the bottle 2 contains the desired quantity of the product P (see FIG. 3), the end 3 of the bottle 2 is closed by means of welding. The roll-on applicator is ready for use. It is illustrated in FIGS. 4 and 5.

When the user wishes to apply a quantity of the product, he grips the tube 2 with one hand and rotates the small bar 6 provided on the cap 5 relative to the remainder of the body 1. This results in breakage of the weakened zone 8 and releases the part of the ball 9 that was in the cylindrical zone 41 interior to the cap 5. The user can then press on the tube 2 to release the product and roll the ball 9 over the surface to be treated. The ball 9 rotates in the part 42 in the form of a spherical portion of the housing 4. It is loaded with the product over its part in contact with the product P. The part loaded in this manner is then rotated so that it comes into contact with the surface to be treated, where it deposits the product P.

When the quantity of product contained in the roll-on applicator is used completely the user can throw away the applicator.

I claim:

1. A single use roll-on applicator for a liquid or pasty cosmetic or pharmaceutical product comprising a tubular body having a closed end and an applicator end, said applicator end having an interior surface engaging a portion of a spherical ball, said interior surface having an inner edge and an outer portion, said interior surface being curved to complement the surface of said ball engaged therewith, said interior surface having a movable rib located at said inner edge of said interior surface to allow insertion of said ball, said outer portion being substantially cylindrical and having an external surface defining an integrally formed cap for said applicator, said external surface including a peripheral line of reduced thickness for facilitating separation of said cap from said tubular body, said curved interior surface being dimensioned to allow said ball to project beyond said peripheral line, said cap including a small rectangular bar extending outwardly of said tubular body.

2. Device according to claim 1 characterised in that the part of the body (1) forming the container (2) is in the form of a tubular bottle.

3. Device according to claim 1 characterised in that the peripheral line consists of a thin-walled weakened zone (8) situated between two thicker zones.

* * * * *